US005324898A

United States Patent [19]

McCormack et al.

[11] Patent Number: 5,324,898

[45] Date of Patent: Jun. 28, 1994

[54] MOTION DETECTOR AND ASSOCIATED SYSTEM

[75] Inventors: Brian C. McCormack, Danton; James R. Cox, Irving; Richard H. Wallace, Plano; Kevin S. Hodge, Rowlett, all of Tex.

[73] Assignee: Texas Instruments Incorporated, Dallas, Tex.

[21] Appl. No.: 834,891

[22] Filed: Feb. 11, 1992

[51] Int. Cl.[5] ..... H01H 3/18

[52] U.S. Cl. ..... 200/52 R; 200/85 R; 200/5 A

[58] Field of Search ..... 200/5 A, 52 R, 61.41, 200/61.45 R, 61.48, 61.49, 61.51, 61.52, 61.53, 85 R, 86 R, 511, 512

[56] References Cited

U.S. PATENT DOCUMENTS

| | | | |
|---|---|---|---|
| 3,745,288 | 7/1973 | Reimer | 200/166 PC |
| 4,145,584 | 3/1979 | Otterlei | 200/5 A |
| 4,249,552 | 2/1981 | Margolin et al. | 133/1 R |
| 4,320,573 | 3/1982 | Larson | 29/622 |

*Primary Examiner*—A. D. Pellinen
*Assistant Examiner*—Michael A. Friedhofer
*Attorney, Agent, or Firm*—William E. Hiller; Richard L. Donaldson

[57] ABSTRACT

A detector assembly (20) detects motion by utilizing a plurality of motion detectors (22–28), each detector having a first finger (40) and a second finger (42). First finger (40) has a signal line (36) on the inner surface (32) and second finger (42) has a ground line (38) disposed on another portion of inner surface (32). Spacer (46) keeps fingers (40) and (42) out of physical contact in the normal position so that there is an open circuit between signal line (36) and ground line (38). When a moving object (50) strikes first finger (40), first finger (40) is deflected downward so that first finger (40) and second finger (42) make physical contact at contact point (48), thereby establishing a closed circuit between signal line (36) and ground line (38). In this fashion a detection pulse is generated. The substrate (30) of detector assembly (20) is made of a resilient, flexible material such as a synthetic resin, for enhanced sensitivity. Due to the enhanced sensitivity of detector assembly (20), the motion of objects (50) can be detected even though such motion is random, i.e. the motion of objects does not have to be precisely controlled in the vicinity of detector assembly (20).

9 Claims, 3 Drawing Sheets

MOTION DETECTOR AND ASSOCIATED SYSTEM

BACKGROUND OF THE INVENTION

1. Field of the Invention

This invention relates generally to motion detector systems and more particularly, to electromechanical motion detectors particularly used for sensing light-weight objects.

2. Description of the Prior Art

A number of different technologies are used for motion detection. Mechanical motion detectors such as a turnstile are well known. Other smaller mechanical detectors can be used for motion detection but such detectors often lack sensitivity for light-weight objects. Other motion detectors are electromechanical in nature, e.g. pressure gauges.

Optical motion detectors normally exhibit greater sensitivity than mechanical detectors but, like mechanical detectors, each motion detector unit requires a separate assembly when incorporated into a system.

One motion detector which exhibits greater sensitivity utilizes a laminar piezoelectric film (such as KYNAR) which has printed silver on both sides of the layer of film. The laminar film is mounted on a substrate, for example polyester. When an object strikes the unit the physical vibrations caused by the contact generate a potential across the printed silver electrodes and thus the motion of the object under consideration can be electrically detected by the voltage pulse. Another problem with the piezoelectric film is its expense and the fact that a lamination process is necessary to attach the piezoelectric film to the substrate thereby causing additional manufacturing and design difficulties.

Another motion detector is a conventional electronic keyboard, such as a MYLAR keyboard wherein a key is disposed above an electrical contact. In this case the object whose motion is to be detected is a human finger and so the motion not only requires control but is indeed intentional. Thus this type of system is impractical for detectors intended to detect random motion.

SUMMARY OF THE INVENTION

The motion detector and associated system of the present invention provide a sensitive motion detector in a simple, unitary design which is easy to manufacture. The invention can be utilized on an inexpensive substrate such as a low-cost polyester, avoiding the expense of systems having optical devices or piezoelectric film. Moreover, the present invention provides a motion detector which is inexpensive, unitary in design and sensitive enough for light-weight objects. The invention further provides such a motion detector which is easily manufacturable and is suited for a variety of uses.

The invention further provides a system utilizing one or more of the motion detectors, according to the present invention, incorporating the benefits mentioned.

Generally speaking, the invention provides a motion detector for detecting motion of an object, the detector including an insulative substrate presenting a contact surface, a first electrical conductor adjacent the contact surface of the substrate, and a second electrical conductor adjacent the contact surface of the substrate, the first and second conductors normally not in physical contact. The substrate is configured to form a first finger and a second finger, with the first and second fingers opposed and spaced so that when the object strikes one of the fingers, the pair of fingers temporarily touch, whereby the first and second conductors come into physical contact.

In preferred embodiments, the motion detector is incorporated in a system having a frame with a rib. The fingers of the motion detector are different in length and a spacer is disposed on one of the fingers so as to avoid inadvertent physical contact between the two fingers. In particular preferred embodiments, the first conductor is disposed on the first finger and the second conductor is disposed on the second finger so that when the moving object strikes one of the fingers the first conductor and the second conductor are brought into physical, and therefore electrical contact.

DETAILED DESCRIPTION OF THE PREFERRED EMBODIMENT.

Figure 1A:
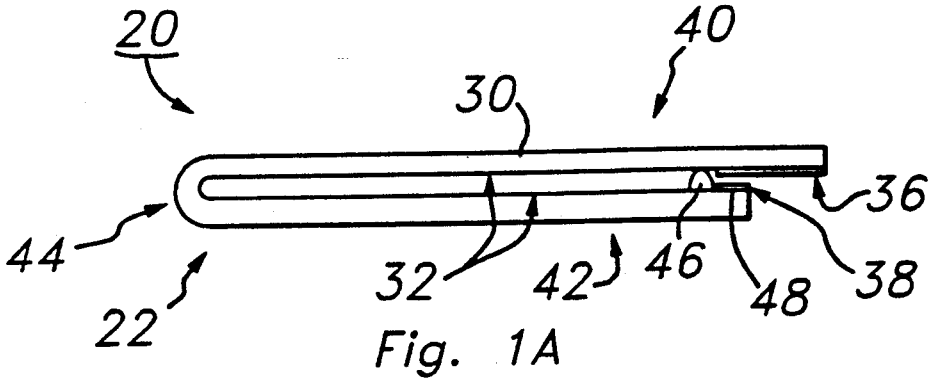
FIG. 1A is a side elevational view of a detector assembly in accordance with the present invention.

Referring now to the drawings in general and FIG. 1A in particular, a detector assembly 20 having four motion detectors 22, 24, 26, 28 (only one motion detector 22 is shown in FIG. 1A, see FIG. 2 where all four motion detectors 22–28 are shown) is depicted. Each motion detector, like first motion detector 22, has an insulative substrate 30 presenting an inner or contact surface 32. A first electrical conductor or signal line 36 and a second conductor or ground line 38 are both disposed adjacent contact surface 32 (see also FIG. 2). Substrate 30 is configured to form a first finger 40 and a second finger 42. Note that FIG. 2 depicts the detector assembly 20 prior to the formation of the configuration of FIGS. 1A and 1B. In other words, detector assembly 20 of FIG. 2 is folded to form the configuration of FIG. 1A. First finger 40 and second finger 42 are joined by a central or connecting portion 44 of substrate 30.

Resilient, flexible substrate 30, the thickness of which varies depending on the application, is preferably formed of a polyester such as MYLAR, although many other synthetic resin materials can be used. Indeed any sufficiently resilient, flexible material can be used.

In accordance with a preferred embodiment of the invention, first finger 40 and second finger 42 (which are normally not in physical contact except where they are joined at central portion 44) have different lengths.

Second finger 42 includes spacer 46 and contact point 48 as indicated in FIG. 1A. As will be readily appreciated, signal line 36 is located on first finger 40 and ground line 38 is located on second finger 42. Thus due to the spacing of first finger 40 and second finger 42, signal line 36 and ground line 38 normally constitute an open circuit (see also FIG. 2). As an alternative, first finger 40 could be situated over some element other than second finger 42, (e.g. a portion of a frame, see rib 74 of FIG. 7) as long as the other element included ground line 38 disposed so that signal line 36 could be brought into contact therewith or vice versa.

Figure 1B:
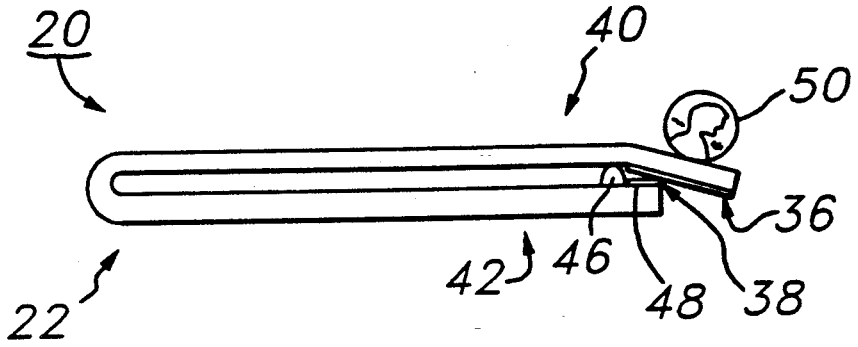
FIG. 1B is the same view of the detector assembly as in FIG. 1, with an object striking the detector assembly.
Figure 2:
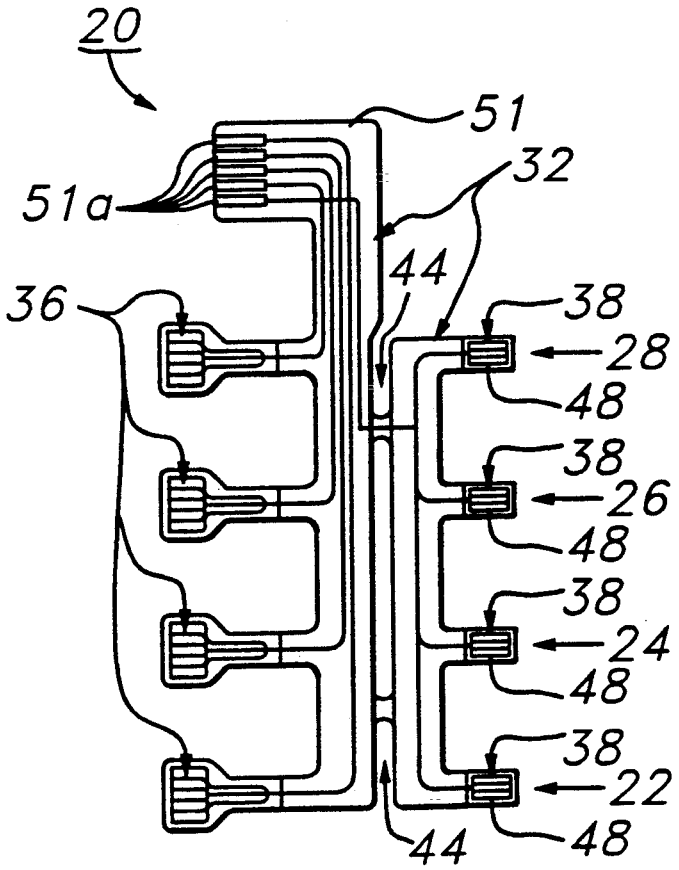
FIG. 2 is a plan view of a contact surface of the detector assembly prior to the detector assembly being formed as shown in FIG. 1A.

Referring to FIG. 1B, object 50 (e.g. a coin) is shown striking detector assembly 20 on first finger 40 of first motion detector 22. The striking action of object 50 causes the first finger 40 to deflect toward and contact and second finger 42 at contact point 48 so that signal line 36 and ground line 38 are brought into physical contact, and therefore electrical communication at contact point 48. Thus a signal can be generated from this contact when electricity is run through lines 36 and 38. Such a signal can be used for detection purposes according to the invention, as is well known in the art.

Referring to FIG. 2, signal lines 36 and ground lines 38 are formed on contact surface 32 (preferably of silver) using conventional screen printing techniques. However photolithographic techniques, well known in the art, can also be used. Screen printing of insulation is used to prevent inadvertent contacts and electromigration. Detector assembly 20 includes tail 51 where each respective signal line 36 and ground line 38 from detectors 22–28 converge as shown. Electrical contact can thus be made with other elements or devices at connective element (s) 51*a*.

Figure 3:
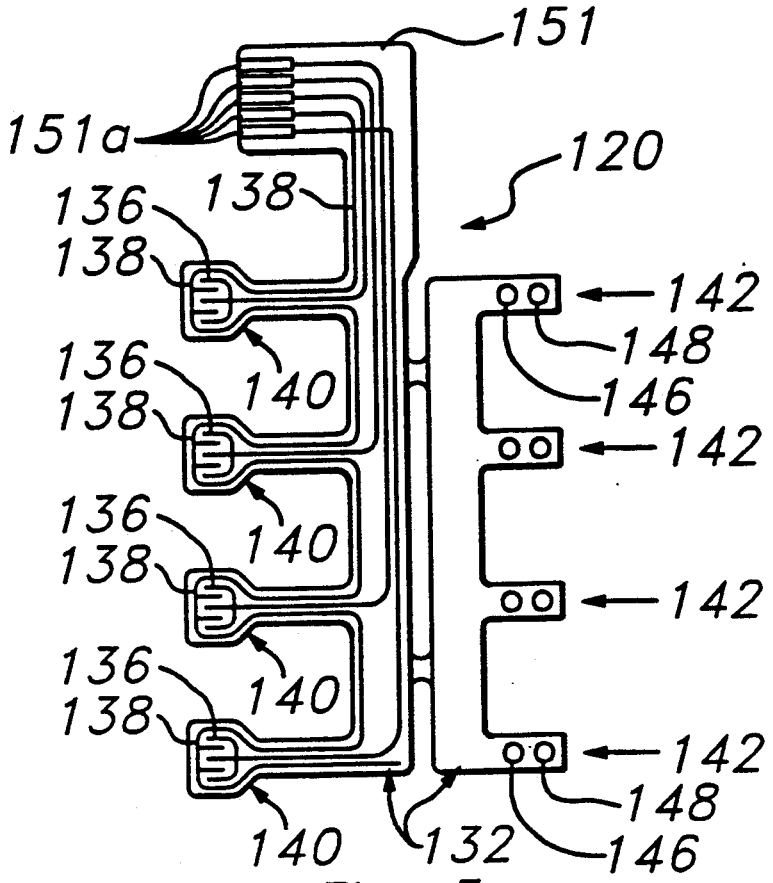
FIG. 3 is a view similar to that of FIG. 2 depicting an alternative embodiment of a detector assembly.

Referring to FIG. 3, an alternative embodiment detector assembly 120 is shown wherein ground line 138 and signal line 136 are both disposed on each first finger 140 in an interdigitated fashion. Detector 120 includes a tail 151 with connective elements 151*a* in a manner analogous to tail 51 of FIG. 2. Spacer 146 and conductive contact point 148 are disposed on each second finger 142 as shown. When object 50 strikes first finger 140, signal line 136 and ground line 138 (not shown) are brought into electrical contact with one another via mutual contact with contact point 148.

Figure 4:
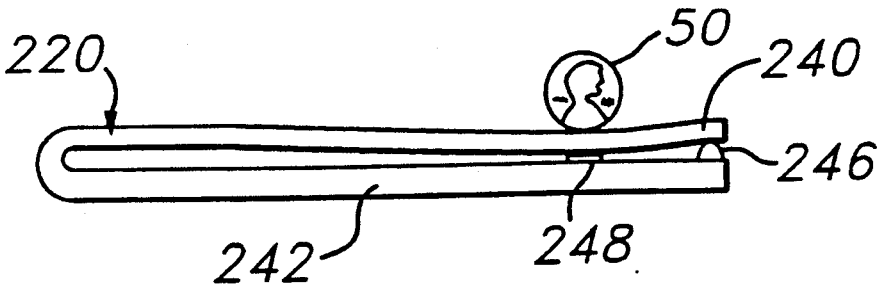
FIG. 4 is a side elevational view of another alternative embodiment detector assembly and an object striking it.

FIG. 4 depicts an alternative detector assembly 220 having first finger 240 and second finger 242, each of substantially equal length. In this embodiment the positions of spacer 246 and contact point 248 are reversed from that seen in FIGS. 1A and 1B.

Figure 5:
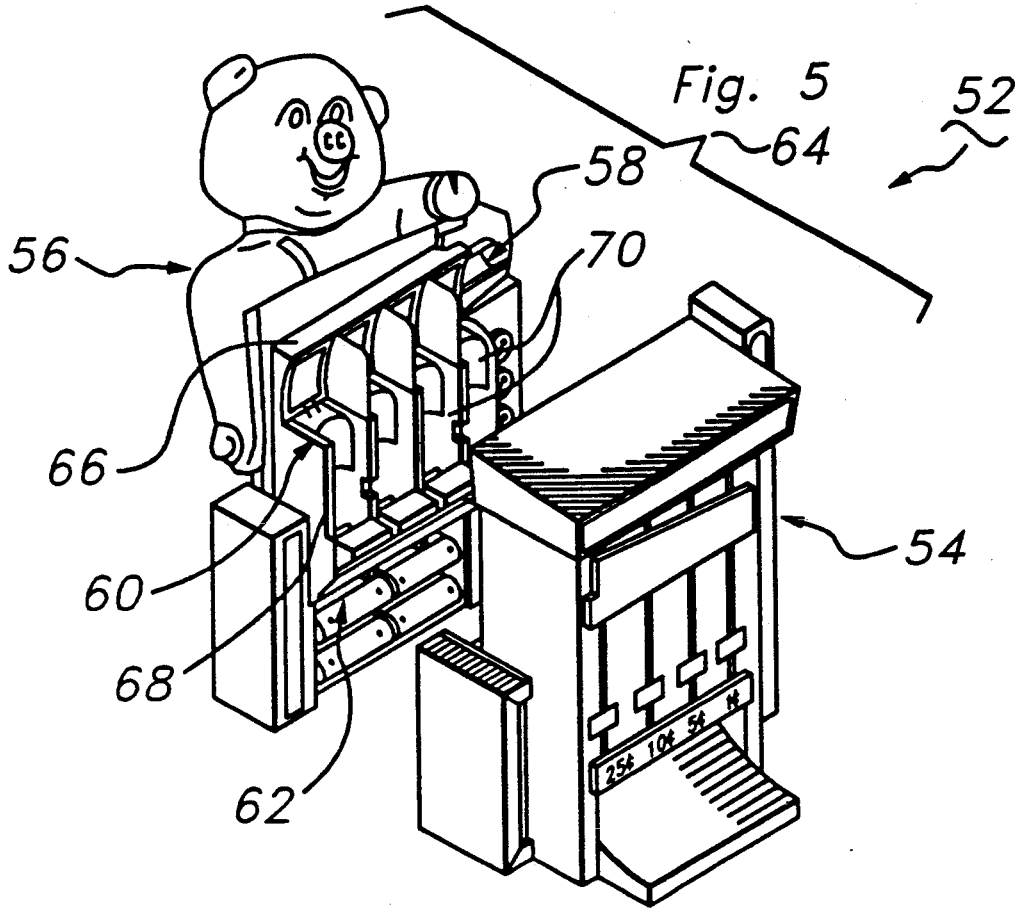
FIG. 5 is an exploded, perspective view of an example system incorporating the detector assembly of FIG. 1A in accordance with the invention.

Referring to FIG. 5, example system 52 is shown in an exploded view with a front end 54 and a back end 56 which incorporates detector assembly 20 System 52 is used to store money while providing an educational experience for a user (typically a young child). The user places coin 50 (e.g. a penny, nickel, dime or quarter) in slot 58 and system 52 announces (by speech synthesis) the value of coin 50 deposited. System 52 also dispenses stored coins 50 and similarly announces the value thereof. As another feature, system 52 will announce the total monetary value of stored coins 50 at a given time. Of course detector assembly 20 can be used in other applications; its use in system 52 is simply illustrative.

Hence motion detection of deposited and dispensed coins 50 is essential to the correct functioning of system 52. First detector assembly 20 is positioned generally as indicated at reference numeral 60 (to detect deposited coins). Second detector assembly 20 is positioned generally as indicated at reference numeral 62 (to detect dispensed coins). The first detector assembly 20 is positioned as indicated at 60 in FIG. 5, comprising the discrete motion detectors 22, 24, 26, and 28 as shown in FIG. 2. The second detector assembly 20 comprising discrete motion detectors 22, 24, 26, and 28 is positioned as indicated at 62 in FIG. 5. As will be apparent, the respective motion detectors 22, 24, 26, and 28 of the first detector assembly 20 extend forwardly from a coin-receiving assembly communicating with the slot 58, the coin-receiving assembly taking the form of a sorter 66.

Figure 6:
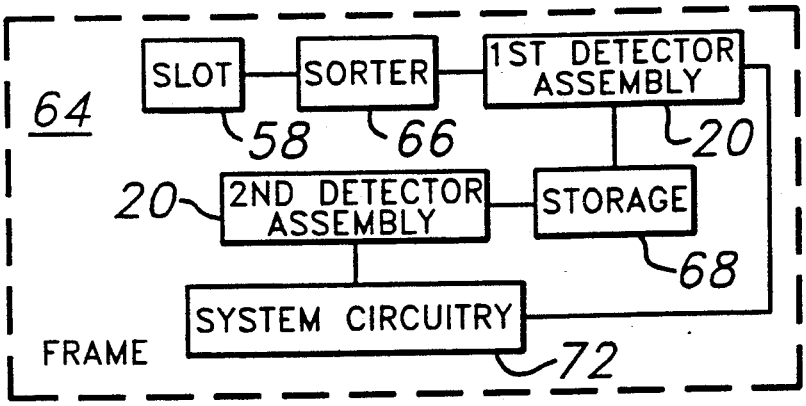
FIG. 6 is a schematic diagram of the system of FIG. 5.

System 52 also includes a frame or housing 64 a sorter 66, storage 68 including channels or chutes 70 and system circuitry 72 (which is schematically represented in FIG. 6). Sorter 66 may, for example, mechanically sort coins 50 utilizing gravity and geometrically varied holes appropriate for such a selection scheme, as is readily appreciated by one skilled in the art.

Referring to FIG. 6, system circuitry 72 is electrically connected to first detector assembly 20 and second detector assembly 20, so that depositing and dispensing of coins 50 is appropriately monitored. The connection takes place at connective elements 51*a* (see FIG. 2). System circuitry 72 includes circuitry suitable for such monitoring (e.g. a microprocessor with an accumulator which is incremented with each pulse from first detector assembly 20 or decremented with each pulse from second detector assembly 20). Of course system circuitry 72 is suitably configured to distinguish between detector signals from the various motion detectors 22–28 (not shown in FIG. 6) and the counterpart motion detectors of second detector assembly 20, so as to determine the monetary significance of each detection. System circuitry 72 therefore easily maintains a running tally of the number of each type of coin 50 stored and the total monetary value stored in system 52. System circuitry 72 also preferably includes speech synthesis circuitry with capability for aurally communicating requested information to the user.

Figure 7:
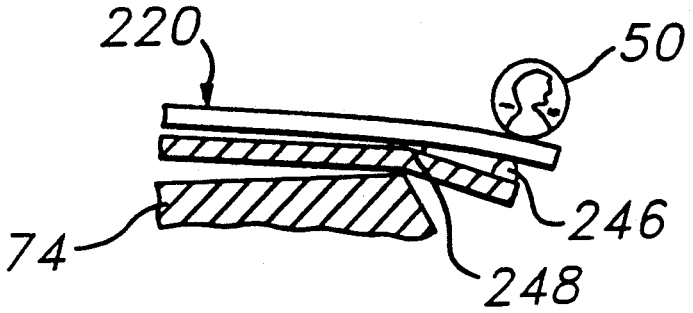
FIG. 7 is a detailed view of a portion of the detector assembly and a portion of a frame of the system of FIG. 5.

Referring to FIG. 7, an alternative embodiment of system 52 is shown wherein frame 64 (not shown) includes a rib 74 partially, cross-sectionally shown, which is closely positioned under modified detector assembly 220 to provide "diving board" action when coin 50 strikes detector assembly 220. Thus greater detection reliability is achieved. In this embodiment the positions of spacer 246 and contact point 248 are reversed to enhance the diving board effect (compare FIG. 1B). Of course the positioning of signal lines and ground lines may be appropriately repositioned in order to better utilize the modified position of contact point 248.

In operation, a user places coin 50 (e.g., a dime) in slot 58. Sorter 66 sorts coin 50 to the appropriate channel (i.e. the dime channel), where it falls past motion detector 24 (see FIG. 2—also see the indicia corresponding to the four channels 70 at the bottom of front end 54 of system 52 in FIG. 5). Channel 70 is appropriately configured so that coin 50 will contact motion detector 24 as it falls past as shown in FIG. 1B. Upon contact of the coin 50 with the motion detector 24, the first finger 40 is deflected in a direction so as to contact the second finger 42 and in a manner causing electrical contact between the respective contact points 36 and 38 which are then in engagement with each other. In this respect, as the coin 50 falls past the terminal ends of the first and second fingers of the motion detector 24, the first and second fingers 40, 42 are clear of interference by the frame or housing 64 so as to permit deflecting movement of one or both of the fingers of the motion detector to occur in conjunction with the placement of the coin 50 in contact with the motion detector 24.

Although the motion is guided in the sense that coin 50 is routed to channel 70, the falling motion of coin 50 is relatively random. A more restrictive or more precise channeling of coin 50 is not required because of the sensitivity of motion detectors 22–28 in accordance with the present invention. All that is required is that channel 70 be sufficiently narrow so that coin 50 consistently makes some contact with outer surface 34 of first finger 40 (see FIG. 1B).

When coin 50 strikes detector 24, first finger 40 and second finger 42 contact so that there is a closed circuit between signal line 36 and ground line 38 of motion detector 24. A signal is thereby generated, and is sensed by system circuitry 72 as described above. A running tally is then incremented by one unit and such information is stored in the memory of system circuitry 72 so that system 52 effectively knows that a dime has just been deposited. Thus, not only will system 52 be able to state the new total of dimes stored in storage 68, but also the new total monetary value of coins 50 stored in system 52. Then, as recited above, the user can obtain such information upon command to the system by appropriate inputs to the system as will be readily appreciated by those skilled in the art. As a substitute or addition to the speech synthesizer capability, a display capability (e.g. an LCD connected to a processor) can be incorporated into system 52.

Figure 8:
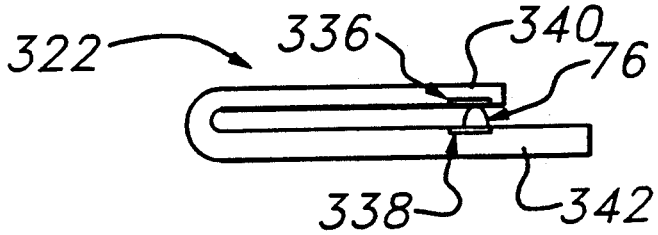
FIG. 8 is yet another alternative embodiment of a detector assembly featuring a motion detector which is normally electrically closed.

Referring to FIG. 8, another alternative motion detector 322 is shown. The main difference is that in this embodiment motion detector 322 is normally electrically closed. Electrical connector 76 makes a continuous electrical connection between first finger 340 and second finger 342, thereby placing ground line 338 and signal line 336 normally in contact. The generation of an open circuit is the type of signal which indicates motion in this embodiment. Hence, when object 50 (not shown) strikes finger 342 it deflects second finger 342 away from first finger 340 so that electrical connection is broken between signal line 336 and ground line 338, thus generating a voltage change which is readily detectable as will be appreciated by those skilled in the art.

Although the invention has been described in detail herein with reference to its preferred embodiment and certain described alternatives, it is to be understood that this description is by way of example only, and is not to be construed in a limiting sense. It is to be further understood that numerous changes in the details of the embodiments of the invention, and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A motion detecting device comprising:

a flexible non-conductive elongated strip folded at an intermediate location thereon to provide first and second non-conductive fingers connected at one end by an integral fold portion and extending from the integral fold portion free of support and in spaced substantially parallel relation with respect to each other;

said first finger being disposed above said second finger;

the surface of said first finger opposed to said second finger having a first contact member of conductive material thereon disposed at least in proximity to the terminal end thereof;

the surface of said second finger opposed to said first finger having a second contact member of conductive material disposed in spaced registration with said first contact member on the opposed surface of said first finger; and a spacer element on one of the opposing surfaces of said first and second fingers extending outwardly thereof and into engagement with the other of the opposing surfaces of said first and second finger, said spacer element being located inwardly of the terminal end of the one of said first and second fingers on which it is disposed but in proximity thereto so as to be relatively remotely located with respect to said integral fold portion in said flexible non-conductive elongated strip;

said flexible non-conductive elongated strip being responsive to the placement of an object on said first finger thereof at least in proximity to the terminal end of said first finger for depressing said first finger about said spacer element as a fulcrum to produce engagement between said first and second contact member on the opposing surfaces of said first and second fingers and enabling subsequent movement of the object past the flexible non-conductive elongated strip.

2. A motion detecting device as set forth in claim 1, wherein said first finger of said flexible non-conductive elongated strip extends beyond the terminal end of said second finger so as to be of increased length with respect to said second finger.

3. A motion detecting device as set forth in claim 1, wherein said first and second fingers of said flexible non-conductive elongated strip are of substantially equal lengths.

4. A motion detecting device as set forth in claim 1, wherein said spacer element is located at the terminal end of said one of said first and second fingers on the surface thereof opposed to the other of said first and second fingers;

said first and second contact member being respectively disposed on the surfaces of said first and second fingers opposed to each other and located inwardly of the terminal ends of said first and second fingers.

5. A repository bank for storing coins, said bank comprising:

a housing defining an inner chamber;

said housing having a coin-receiving slot providing communication with said chamber;

sorter means mounted within the chamber of said housing and in registration with said slot, said sorter means selectively identifying respective coins of different dimensions based upon coin sizes;

a plurality of coin-receiving chutes provided in said chamber of said housing, each of said plurality of chutes being associated with a particular coin different from the coins with which the remaining chutes are respectively associated, said plurality of chutes being arranged below said sorter means;

said sorter means being positioned between said slot in said housing and said plurality of coin-receiving chutes and providing selective communication with respective chutes dependent upon coin size;

a plurality of motion detectors respectively associated with said sorter means and each of the chutes arranged therebelow, each of said motion detectors being mounted between said sorter means and the chute corresponding thereto and comprising:

flexible non-conductive elongated strip means connected to said sorter means, said flexible non-conductive elongated strip means providing first and second non-conductive fingers extending outwardly from said sorter means in a direction overlying the respective chute corresponding thereto, said first finger being disposed above said second finger, the surface of said first finger opposed to said second finger having a first contact member of conductive material thereon disposed at least in proximity to the terminal end thereof, the surface of said second finger opposed to said first finger having a contact member of conductive material thereon disposed at least in proximity to the terminal end thereof, the surface of said second finger opposed to said first finger having a contact member of conductive material thereon in spaced registration with said first contact member, and a spacer element on one of the opposing surfaces of said first and second fingers extending outwardly thereof and into engagement with the other of the opposing surfaces of said first and second fingers;

a respective one of said motion detectors being responsive to the insertion of a coin of a particular diameter in the coin-receiving slot of said housing and the subsequent movement of the coin through said sorter means to produce relative movement between said first and second fingers of the motion detector corresponding to the selective sorting of said sorter means to bring said first and second contact members into engagement as the coin traverses the motion detector and falls into the corresponding chute; and means responsive to the detection of coin motion by a particular motion detector for registering the value of the coin as inserted into the coin-receiving slot in said housing.

6. A repository bank for storing coins as set forth in claim 5, wherein said sorter means comprises:

a track mounted within the chamber of said housing and in registration with said coin-receiving slot, said track including an upstanding wall extending the length thereof and disposed forwardly of said coin-receiving slot with respect to the front of said housing, the upstanding wall of said track being provided with a plurality of coin-sizing apertures arranged along the length thereof in spaced relationship with respect to each other;

each of said apertures being of a size different from the sizes of the other apertures and having a dimension to enable a coin of a corresponding size to pass therethrough;

each of said plurality of chutes being associated with a particular coin-sizing aperture in the upstanding wall of said track and being arranged therebelow;

each of said motion detectors being mounted between a respective coin-sizing aperture and the chute corresponding thereto; and said respective one of said motion detectors being responsive to the insertion of a coin of a particular diameter in the coin-receiving slot of said housing and the subsequent movement of the coin through the coin-sizing aperture in said upstanding wall of said track corresponding thereto in producing relative movement between said first and second fingers of the motion detector corresponding to the coin-sizing aperture through which the coin has passed.

7. A repository bank for storing coins as set forth in claim 5, wherein said housing includes a coin-dispensing opening communicating with the plurality of coin-receiving chutes and arranged therebelow;

means operably associated with each of said chutes for selectively releasing coins as stored in any one of said plurality of chutes;

second plurality of motion detectors respectively associated with each of said chutes and arranged therebelow, each of said second plurality of motion detectors comprising:

flexible non-conductive elongated strip means providing first and second non-conductive fingers extending outwardly across said coin-dispensing opening in registration with the bottom of a respective one of said plurality of chutes corresponding thereto, said first finger being disposed above said second finger, the surface of said first finger opposed to said second finger having a first contact member of conductive material thereon disposed at least in proximity to the terminal end thereof, the surface of said second finger opposed to said first finger having a contact member of conductive material thereon in spaced registration with said first contact member, and a spacer element on one of the opposing surfaces of said first and second fingers extending outwardly thereof and into engagement with the other of the opposing surfaces of said first and second fingers;

a respective one of said second plurality of motion detectors being responsive to the selective release of a coin from the chute corresponding thereto in response to the actuation of said coin-releasing means and the subsequent movement of the coin onto said respective one of said second plurality of motion detectors to produce relative movement between said first and second fingers of said respective one of said second plurality of motion detectors to bring said first and second contact members into engagement as the coin traverses said respective one of said second plurality of motion detectors and falls through the coin-dispensing opening in said housing; and means responsive to the detection of coin motion by said respective one of said second plurality of motion detectors for registering the value of the coin as dispensed form the bank via the coin-dispensing opening in said housing.

8. A motion detecting device comprising:

a flexible non-conductive elongated strip folded at an intermediate location thereon to provide first and second non-conductive fingers connected at one end by an integral fold portion and extending form the integral fold portion free of support and in spaced substantially parallel relation with respect to each other;

said first finger being disposed above said second finger;

the surface of said first finger opposed to said second finger having a first contact member of conductive material thereon disposed at least in proximity to the terminal end thereof;

the surface of said second finger opposed to said first finger having a second contact member of conductive material disposed in spaced registration with said first contact member on the opposed surface of said first finger;

said first contact member on the surface of said first finger opposed to said second finger being disposed in registration with the terminal end of said second finger;

said second contact member on the surface of said second finger opposed to said first finger being located at the terminal end of said second finger; and a spacer element on one of the opposing surfaces of said first and second fingers extending outwardly thereof and into engagement with the other of the opposing surfaces of said first and second fingers, said spacer element being located inwardly of the terminal end of the one of said first and second fingers on which it is disposed but in proximity thereto so as to be relatively remotely located with respect to said integral fold portion in said flexible non-conductive elongated strip;

said flexible non-conductive elongated strip being responsive to the placement of an object on said first finger thereof at least in proximity to the terminal end of said first finger for depressing said first finger about said spacer element as a fulcrum to produce engagement between said first and second contact members on the opposing surfaces of said first and second fingers and enabling subsequent movement of the object past the flexible non-conductive elongated strip.

9. A motion detecting device comprising:

a flexible non-conductive elongated strip folded at an intermediate location thereon to provide first and second non-conductive fingers connected at one end by an integral fold portion and extending from the integral fold portion free of support and in spaced substantially parallel relation with respect to each other;

said first finger being disposed above said second finger;

the surface of said first finger opposed to said second finger having a first contact member of conductive material thereon disposed at least in proximity to the terminal end thereof;

the surface of said second finger opposed to said first finger having a second contact member of conductive material disposed in spaced registration with said first contact member on the opposed surface of said first finger;

said second finger extending beyond the terminal end of said first finger so as to be of increased length with respect to said first finger;

a spacer element mounted on the surface of said second finger opposed to said first finger and extending outwardly thereof and into engagement with the opposing surface of said first finger, said spacer element being disposed inwardly of the terminal end of said second finger but in proximity thereto and in registration with the terminal end of said first finger so as to be relatively remotely located with respect to said integral fold portion in said flexible non-conductive elongated strip;

said second contact member being provided on said spacer element;

said first contact member on the surface of said first finger opposed to said second finger being located at the terminal end of said first finger in registration with said second contact member on said spacer element; and said first and second contact member normally being in engagement but being separated from each other in response to the placement of an object on the portion of said second finger extending beyond the terminal end of said first finger in a manner deflecting said second finger in a direction away from said first finger and enabling subsequent movement of the object past the flexible non-conductive elongated strip.

* * * * *